US010746477B2

(12) United States Patent
Zhou et al.

(10) Patent No.: US 10,746,477 B2
(45) Date of Patent: Aug. 18, 2020

(54) SYSTEMS AND METHODS FOR DEGASSING AND CHARGING PHASE-CHANGE THERMAL DEVICES

(71) Applicant: Toyota Motor Engineering & Manufacturing North America, Inc., Erlanger, KY (US)

(72) Inventors: Feng Zhou, South Lyon, MI (US); Yanghe Liu, Ann Arbor, MI (US); Ercan Mehmet Dede, Ann Arbor, MI (US); Shailesh N. Joshi, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 587 days.

(21) Appl. No.: 15/288,327

(22) Filed: Oct. 7, 2016

(65) Prior Publication Data

US 2018/0099363 A1 Apr. 12, 2018

(51) Int. Cl.

| | |
|---|---|
| ***F28F 13/00*** | (2006.01) |
| ***F28D 15/04*** | (2006.01) |
| ***F28D 15/02*** | (2006.01) |

(52) U.S. Cl.

CPC ..... *F28D 15/04* (2013.01); *F28D 15/0283* (2013.01); *F28F 2013/008* (2013.01)

(58) Field of Classification Search

CPC . F28D 15/04; F28D 15/0283; F28F 2013/008
See application file for complete search history.

(56) References Cited

U.S. PATENT DOCUMENTS

| | | | | |
|---|---|---|---|---|
| 2,116,442 | A * | 5/1938 | McCluer | C10G 7/00 196/114 |
| 5,406,594 | A * | 4/1995 | Frattolillo | H05H 1/22 376/100 |
| 5,649,998 | A * | 7/1997 | Ungerer | B04C 5/02 96/209 |
| 7,115,227 | B2 | 10/2006 | Mucciardi et al. | |
| 8,888,898 | B1 | 11/2014 | Rice et al. | |
| 9,374,904 | B2 | 6/2016 | Francis et al. | |
| 9,982,092 | B1 * | 5/2018 | Kim | C08G 65/2615 |
| 2015/0226493 | A1 | 8/2015 | Yang et al. | |
| 2016/0076820 | A1 | 3/2016 | Lewis et al. | |
| 2019/0091599 | A1 * | 3/2019 | Manns | B01D 3/10 |

FOREIGN PATENT DOCUMENTS

WO WO20150007001 12/2015

* cited by examiner

*Primary Examiner* — Rick K Chang
(74) *Attorney, Agent, or Firm* — Dinsmore & Shohl LLP

(57) ABSTRACT

Systems and methods for degassing and charging phase-change thermal devices are disclosed. In one embodiment, a system includes a flask, a first shut-off valve fluidly coupled to an outlet of the flask, and a first valve fluidly coupled to the first shut-off valve by a fluid line. The system further includes a second valve fluidly coupled to the first valve, wherein the second valve is operable to be fluidly coupled to the phase-change thermal device, a second shut-off valve fluidly coupled to the second valve, a third valve fluidly coupled to the first valve, a vacuum pump fluidly coupled to the third valve, and a fluid injection device fluidly coupled to the fluid line between the first valve and the first shut-off valve. The fluid injection device draws the working fluid from the flask and injects a desired amount into the phase-change thermal device.

12 Claims, 13 Drawing Sheets

SYSTEMS AND METHODS FOR DEGASSING AND CHARGING PHASE-CHANGE THERMAL DEVICES

TECHNICAL FIELD

The present specification generally relates to systems and methods for charging phase-change thermal devices with working fluid and, more particularly, systems and methods for both degassing and charging miniature phase-change thermal devices with working fluid at precise volume and accurate vacuum levels.

BACKGROUND

A phase-change thermal device is a device that is filled (i.e., charged) with a working fluid that changes to a vapor in response to thermal energy. Example phase-change thermal devices include, but are not limited to, a thermal switch or diode device, a vapor chamber, a heat pipe, and a thermal ground plane. In these devices, a chamber is filled with the working fluid. However, in miniature phase-change thermal device (e.g., devices charged with a working fluid volume of less than or equal to 1 ml), it may be very difficult to control the amount of working fluid injected into the device. In many cases, the volume of working fluid should be precisely controlled so that the phase-change thermal device may operate as desired.

Further, in the case of a thermal switch device, the vacuum level within the thermal switch device is controlled so that the thermal switch devices switches from relatively low thermal conductivity to relatively high thermal conductivity at a desired temperature. The thermal switch device is sensitive to the amount of non-condensable gas left within the chamber. Thus, the presence of non-condensable gas within the thermal device may lead to a non-controllable switching temperature of the thermal switch device.

Accordingly, a need exists for alternative systems and methods for degassing and charging phase-change thermal devices.

SUMMARY

In one embodiment, a system for degassing and charging a phase-change thermal device includes a flask including an inlet for receiving a working fluid and an outlet, a first shut-off valve fluidly coupled to the outlet of the flask, and a first valve fluidly coupled to the first shut-off valve by a fluid line. The system further includes a second valve fluidly coupled to the first valve, wherein the second valve is operable to be fluidly coupled to the phase-change thermal device, a second shut-off valve fluidly coupled to the second valve, a third valve fluidly coupled to the first valve, a vacuum pump fluidly coupled to the third valve, and a fluid injection device fluidly coupled to the fluid line between the first valve and the first shut-off valve. The fluid injection device is operable to draw the working fluid from the flask and inject a desired amount of the working fluid into the phase-change thermal device.

In another embodiment, a system for degassing and charging a phase-change thermal device includes a flask including an inlet for receiving a working fluid and an outlet. The system further includes a filter fluidly coupled to the inlet of the flask, a reservoir fluidly coupled to the filter, a heating element thermally coupled to the flask and operable to heat the working fluid within the flask, a first shut-off valve fluidly coupled to the outlet of the flask, a first valve fluidly coupled to the first shut-off valve by a first fluid line, and a second valve fluidly coupled to the first valve. The second valve is operable to be fluidly coupled to the phase-change thermal device. The system further includes a second shut-off valve fluidly coupled to the second valve and fluidly coupled to atmosphere, a third valve fluidly coupled to the first valve, a second fluid line fluidly coupled to the third valve, a fluid trap fluidly coupled to the second fluid line, a vacuum pump fluidly coupled to the fluid trap, and a syringe fluidly coupled to the first fluid line between the first valve and the first shut-off valve. The syringe is operable to draw the working fluid from the flask, and inject a desired amount of the working fluid into the phase-change thermal device. The system further includes a third shut-off valve fluidly coupled to an exhaust output of the flask, and fluidly coupled to the atmosphere, and a fourth shut-off valve fluidly coupled to the exhaust output of the flask, and fluidly coupled the second fluid line.

In yet another embodiment, a method for charging a phase-change thermal device includes fluidly coupling the phase-change thermal device to a degassing and charging system. The degassing and charging system includes a flask including an inlet for receiving a working fluid and an outlet, at least one fluid line fluidly coupling the outlet of the flask to the phase-change thermal device, and a fluid injection device fluidly coupled to the at least one fluid line. The method further includes degassing the working fluid by heating the working fluid within the flask and exhausting vapor, filling the at least one fluid line with the working fluid from the outlet of the flask, drawing working fluid into the fluid injection device from the at least one fluid line and the outlet of the flask, and injecting the working fluid within the fluid injection device such that a desired amount of working fluid within the at least one fluid line is displaced into the phase-change thermal device.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
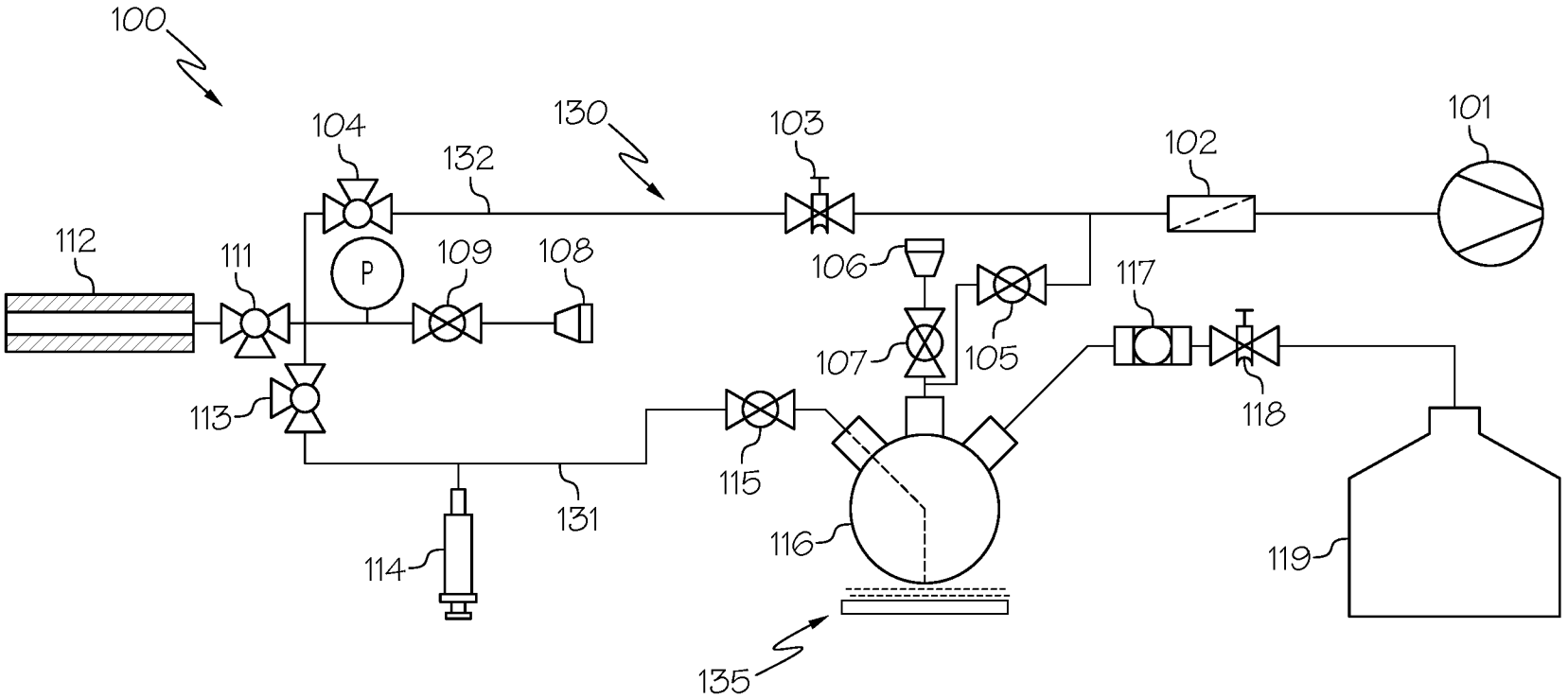
FIG. 1 schematically depicts an example system for degassing and charging a phase-change thermal device according to one or more embodiments described and illustrated herein.

Embodiments of the present disclosure are directed to systems and methods for high-precision degassing, vacuuming and charging of phase-change thermal devices. Thermal devices include, but are not limited to, heat pipes, vapor chambers, thermal ground planes, thermal switches, and the like. Each of these devices is charged with a working fluid, such as, without limitation, water. It should be understood that working fluids other than water may be utilized. In cooling device applications, the working fluid removes heat from a heat generating device, such as a semiconductor device, by changing phase from a liquid to a vapor. In thermal switch device applications, the thermal switch device may change its thermal conductivity at a switching temperature. For example, the thermal switch device may change from less thermally conductive (i.e., insulative) to more thermally conductive when the temperature of the thermal switch reaches the switching temperature. Example non-limiting thermal switch devices are described in U.S. patent application Ser. No. 15/151,679 filed on May 11, 2016 and entitled "Programmable Ultrasonic Thermal Diodes," and U.S. patent application Ser. No. 15/261,063 filed on Sep. 9, 2016 and entitled "Vapor Chamber Heat Flux Rectifier and Thermal Switch," both of which are incorporated herein in their entireties.

Phase-change thermal devices should be charged (i.e., filled) with a particular amount of working fluid for them to operate properly. Charging a phase-change thermal device with the precise amount of working fluid becomes difficult in miniature devices because precise control of the charging amount (e.g., less than or equal to about 1 ml) is challenging. Another challenge is accurate vacuum level control, particularly in thermal switch applications. The switching temperature of the thermal switch is sensitive to the amount of non-condensable gas left in the chamber (i.e., vacuum level).

Embodiments of the present disclosure enable precise charging of a phase-change thermal device (e.g., less than or equal to about 1 ml), as well as accurate vacuum control. More particularly, embodiments described herein are directed to methods and systems that integrate the functions of working fluid degassing, precise vacuum level control, and charging amount control for miniature phase-change thermal devices. Although embodiments are described in the context of charging miniature phase-change thermal device having a working fluid volume of less than or equal to about 1 ml, embodiments are not limited thereto. The systems and methods described herein may be utilized to charge phase-change thermal devices having a working fluid volume that is greater than 1 ml.

The methods and systems may eliminate phase-change thermal device error, and further improve charging accuracy. The embodiments described herein enable the control of charging level uncertainty within about ±1% for a charging amount within a range of about 0.4 ml to about 1 ml, within about ±5% for a charging amount within a range of about 0.07 ml to about 0.2 ml, and within ±10% for a charging amount within a range of about 0.02 ml to about 0.06 ml. The charging speed for the systems and methods described herein are within a range of about 0.1 μl/min to about 3 ml/min. Further, the internal pressure of phase-change thermal devices charged according to embodiments described herein is adjustable with an accuracy of ±0.01 kPa.

Generally, a working fluid, a degassing and charging system, and a phase-change thermal device coupled to the charging system are subjected to a degassing process to remove non-condensable gas from the charging system and the phase-change thermal device. Next, a fluid line in front of the phase-change thermal device is filled with working fluid from a source. A valve connecting the phase-change thermal device to the degassing and charging system is opened. The working fluid within the fluid line in front of the phase-change thermal device is displaced by a fluid injection device (e.g., a syringe) and precisely injected into the phase-change thermal device.

Referring now to FIG. 1, an example system 100 for degassing and charging a phase-change thermal device 112 is schematically illustrated. It should be understood that embodiments of the present disclosure are not limited to the components and configuration depicted in FIG. 1.

Generally, the system 100 includes a reservoir 119 that is a source for working fluid, a flask 116 that stores working fluid from the reservoir 119, a fluid injection device 114, and a vacuum pump 101. In the illustrated embodiment, the flask 116 is a three neck flask having an inlet, an outlet, and an exhaust. A heating element 135 is thermally coupled to the flask 116 to heat the working fluid during a degassing process, as described in more detail below.

A plurality of fluid lines 130 fluidly couples the various components of the system 100. The plurality of fluid lines 130 may be made from any suitable fluid piping. Further, a plurality of valves is disposed within the system 100 to control the flow of working fluid and gasses. The valves described herein may be configured as any known or yet-to-be-developed valves operable to allow or prevent the flow of fluid.

In the illustrated embodiment, a first metering valve 118 and a particulate filter 117 is disposed between the inlet of the flask 116 and the reservoir 119. The first metering valve 118 is operable to control an amount of working fluid provided from the reservoir 119 to the flask 116. The particulate filter 117 is operable to filter out any particulate matter within the working fluid prior to the working fluid reading the flask 116. As an example and not a limitation, the particulate filter 117 may comprise a micron-scale pore filter (e.g., less than 10 μm pore size). It should be understood that, in other embodiments, a particulate filter 117 is not utilized. Further, a valve other than a metering valve may be used to control working fluid flow from the reservoir 119 to the flask 116.

A first shut-off valve 115 is fluidly coupled to the outlet of the flask 116. The first shut-off valve 115 allows or prevents working fluid from exiting the flask 116. The first shut-off valve 115 is fluidly coupled to a first valve 113 by a first fluid line 131, which may be any suitable fluid piping. Although the first valve 113 is illustrated as a three-way valve, embodiments are not limited thereto. The fluid injection device 114 is also fluidly coupled to the first fluid line 131. In the illustrated example, the fluid injection device 114 is configured as a syringe capable of drawing in working fluid and expelling working fluid. However, any device operable to displace a desired amount of working fluid may be utilized. In some embodiments, the fluid injection device 114 comprises a syringe having a mechanically controlled pump or other type of automatically adjustable chamber. The mechanically controlled pump may be programmed to automatically accurately withdraw and inject precise amounts of working fluid at a controllable rate (e.g., within a range of about 0.1 μl/min to about 3 μl/min as a non-limiting example) without manual intervention by an operator. The fluid injection device 114 may be fluidly coupled to the first fluid line 131 by any means, such as by fluid couplings. As described in more detail below, the fluid injection device 114 is configured to inject a small, precise amount of working fluid into the phase-change thermal device 112.

A second valve 111 is fluidly coupled to the first valve 113 and the phase-change thermal device 112. The second valve 111, which in the illustrated example is configured as a three-way valve, is also fluidly coupled to a second shut-off valve 109 that is further fluidly coupled to an exhaust 108 to the environment. In the illustrated example, a digital compound pressure gauge P is disposed between the second valve 111 and the second shut-off valve 109 and that measures the pressure within the system 100.

The first valve 113 is also fluidly coupled to a third valve 104. Although the first valve 113 is illustrated as a three-way valve, embodiments are not limited thereto. The third valve 104 is further fluidly coupled to a second metering valve 103. A fluid trap 102 is fluidly coupled to the third valve 104 by a second fluid line 132. The fluid trap 102 is further fluidly coupled to the vacuum pump 101. It is noted that although only first fluid line 131 and second fluid line 132 are the only fluid lines identified by reference numerals, many additional fluid lines may be present to fluidly couple the various devices of the system.

In the example system 100 illustrated in FIG. 1, a third shut-off valve 105 is fluidly coupled to the exhaust of the flask 116 and an exhaust 106 to the environment. A fourth shut-off valve 107 is also fluidly coupled to the exhaust of the flask 116, and is further fluidly coupled to the second fluid line 132, such as by a coupling, for example.

Figure 2:
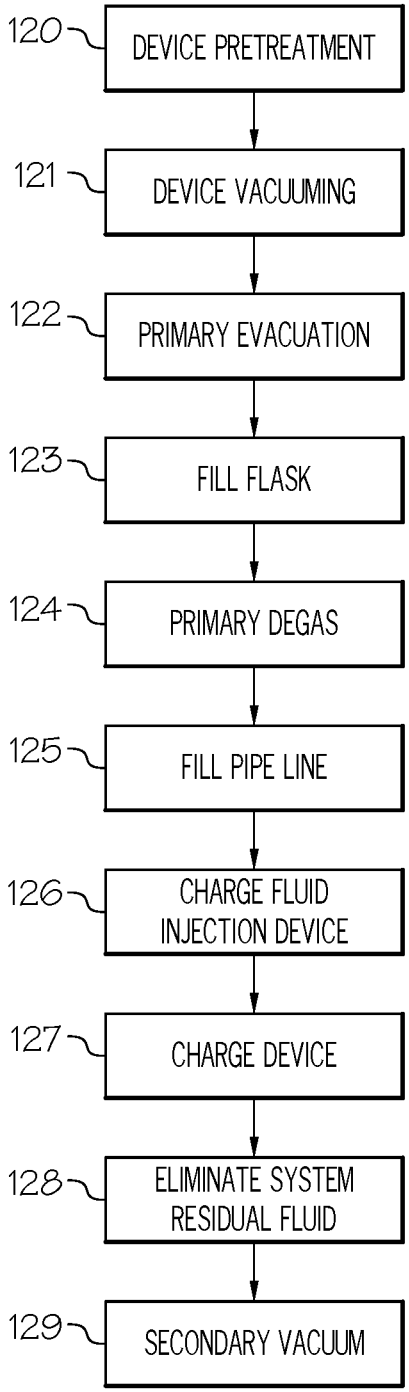
FIG. 2 graphically depicts a flowchart of an example method for degassing and charging a phase-change thermal device according to one or more embodiments described and illustrated herein.

Having described the components of the example system 100 of FIG. 1, an example method of degassing and charging a phase-change thermal device is described with reference to FIGS. 2-11. FIG. 2 is a flowchart that graphically illustrates an example process of degassing and charging a phase-change thermal device 112. It is noted that FIGS. 3-11 illustrate the same system 100 as FIG. 1, and the dashed circles around valves in FIGS. 3-11 denote that the valve is in an open position, whereas valves without a dashed circle are in a closed position.

Generally, the method comprises the steps of primary evacuation of the system 100 and the phase-change thermal device 112, degassing of the working fluid, charging the phase-change thermal device 112 with working fluid, and, in the case where the phase-change thermal device 112 is a thermal switch, secondary vacuuming to achieve a desired pressure within the phase-change thermal device 112.

Figure 3:
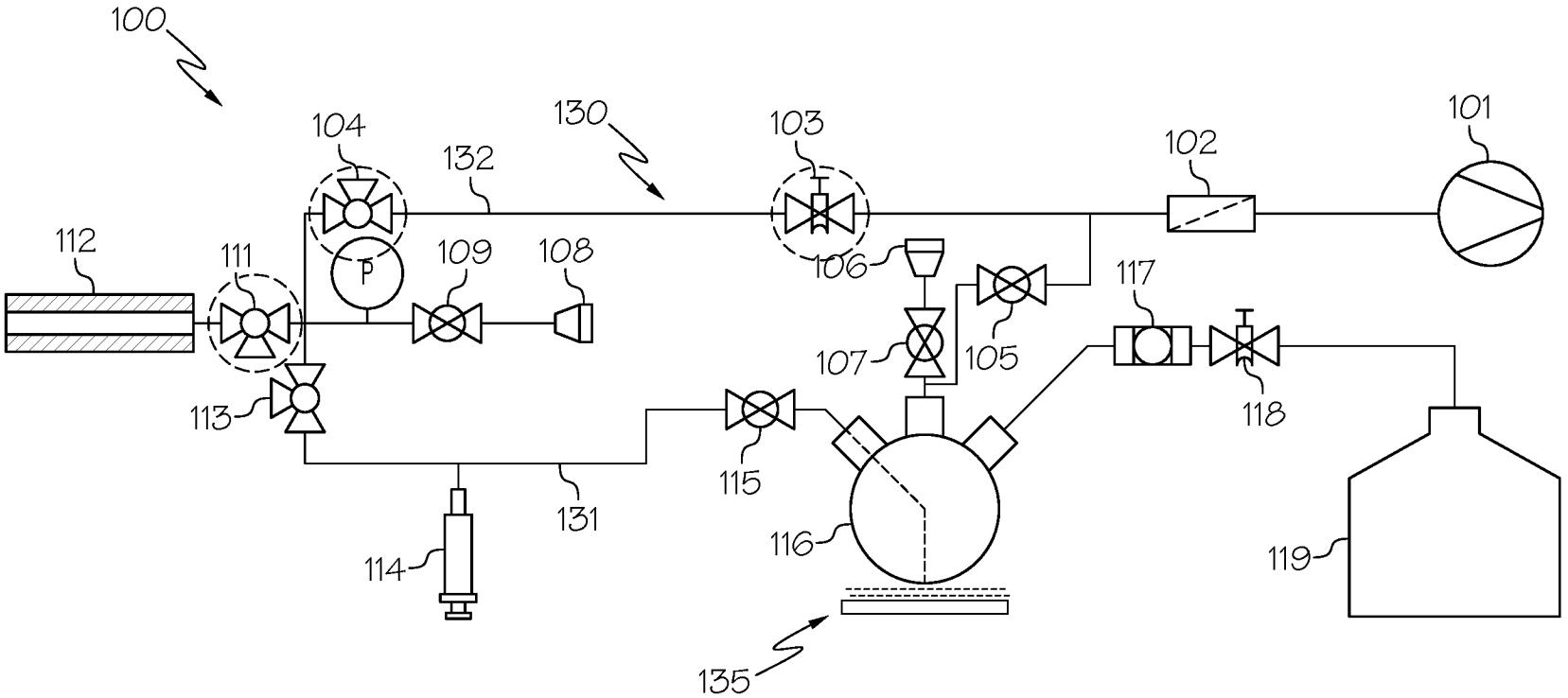
FIG. 3 schematically depicts the example system illustrated in FIG. 1 in a state for pretreating the phase-change thermal device according to one or more embodiments described and illustrated herein.
Figure 4:
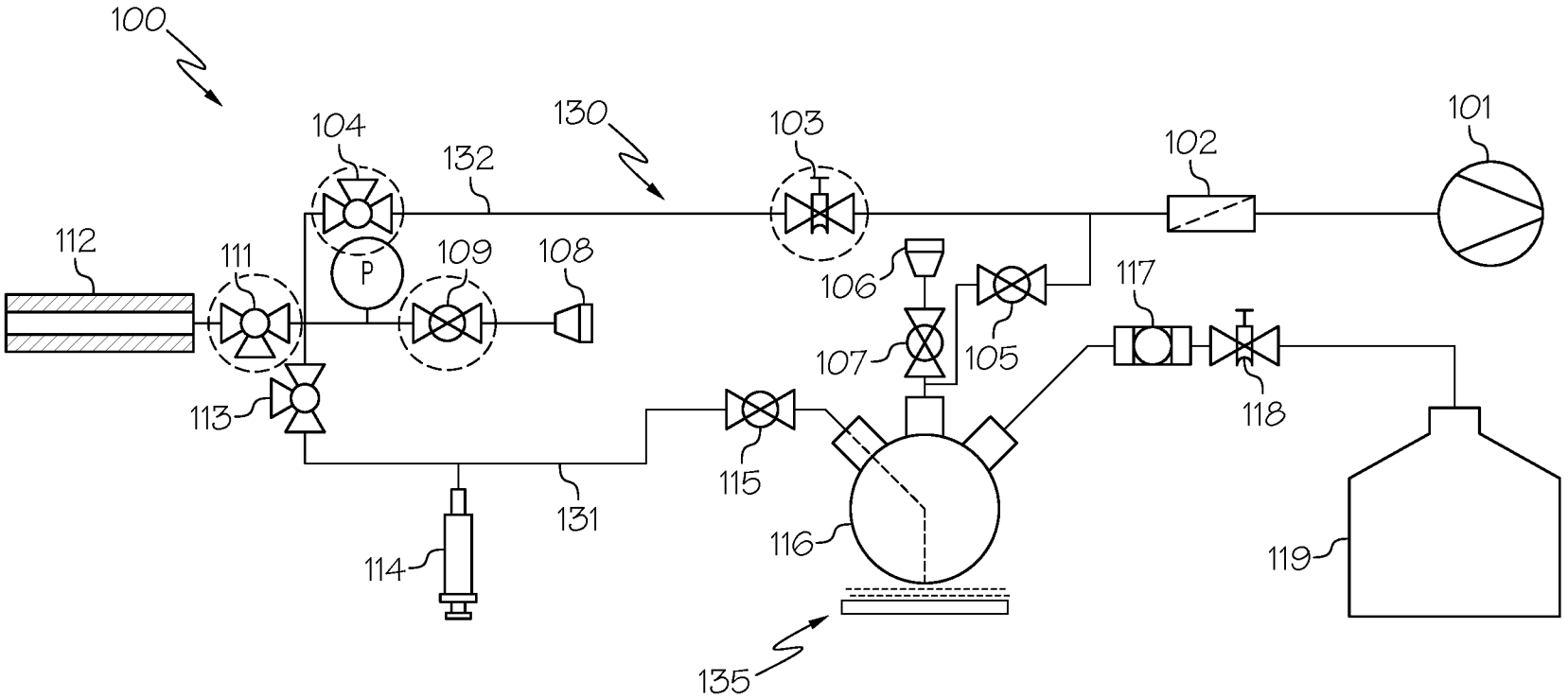
FIG. 4 schematically depicts the example system illustrated in FIG. 1 in a state for vacuuming the phase-change thermal device according to one or more embodiments described and illustrated herein.

Referring to FIG. 2, in a first step, the phase-change thermal device 112 is pretreated (block 120). To ensure the accuracy of the charging amount, the residual moisture within the phase-change thermal device 112 (e.g., within a wicking structure of the phase-change thermal device 112) should be removed. In one example, the phase-change thermal device 112 may be baked in a vacuum over a period of time. In another example and referring to FIG. 1, the surface temperature of the phase-change thermal device is raised by using a heating block (not shown) attached to the phase-change thermal device 112 while all of the valves are closed. As an example and not a limitation, the surface temperature may be raised to 100° C. Referring now to FIG. 3, the second valve 111 and the third valve 104 are then opened. The second metering valve 103 is fully opened. The vacuum pump 101 is turned on. Thus, any fluid within the phase-change thermal device 112 is heated, changes phase to a vapor, and is exhausted through the second valve 111, the third valve 104, the fluid trap 102 and the vacuum pump 101. If there is substantially no moisture left within the phase-change thermal device 112, the pressure inside the phase-change thermal device 112 may be controlled to be very low, e.g., $10^{-3}$ Torr. The heating block is turned off after pretreatment.

Next, if the phase-change thermal device 112 is a thermal switch device, the phase-change thermal device 112 is vacuumed (FIG. 2, block 121). In the case of a thermal switch device, it is expected to start transporting heat (i.e., become more thermally conductive) at a pre-set temperature value. Thus, the pressure inside the phase-change thermal device 112 should be controlled at a desired value. During this step, the pressure of the phase-change thermal device 112 is lowered close to a desired pre-set value, which may reduce the time required to perform any secondary degassing steps by partially removing any non-condensable gas from within the phase-change thermal device 112. Referring to the example of FIG. 4, the phase-change thermal device 112 may be vacuumed by opening the second valve 111 and the second shut-off valve 109 to relieve the vacuum status after the prior pretreatment step. Next, the second shut-off valve 109 is closed, and then the third valve 104 is opened. The second metering valve 103 is slowly opened and closed until the pressure inside the phase-change thermal device 112 reaches a desired value.

Figure 5:
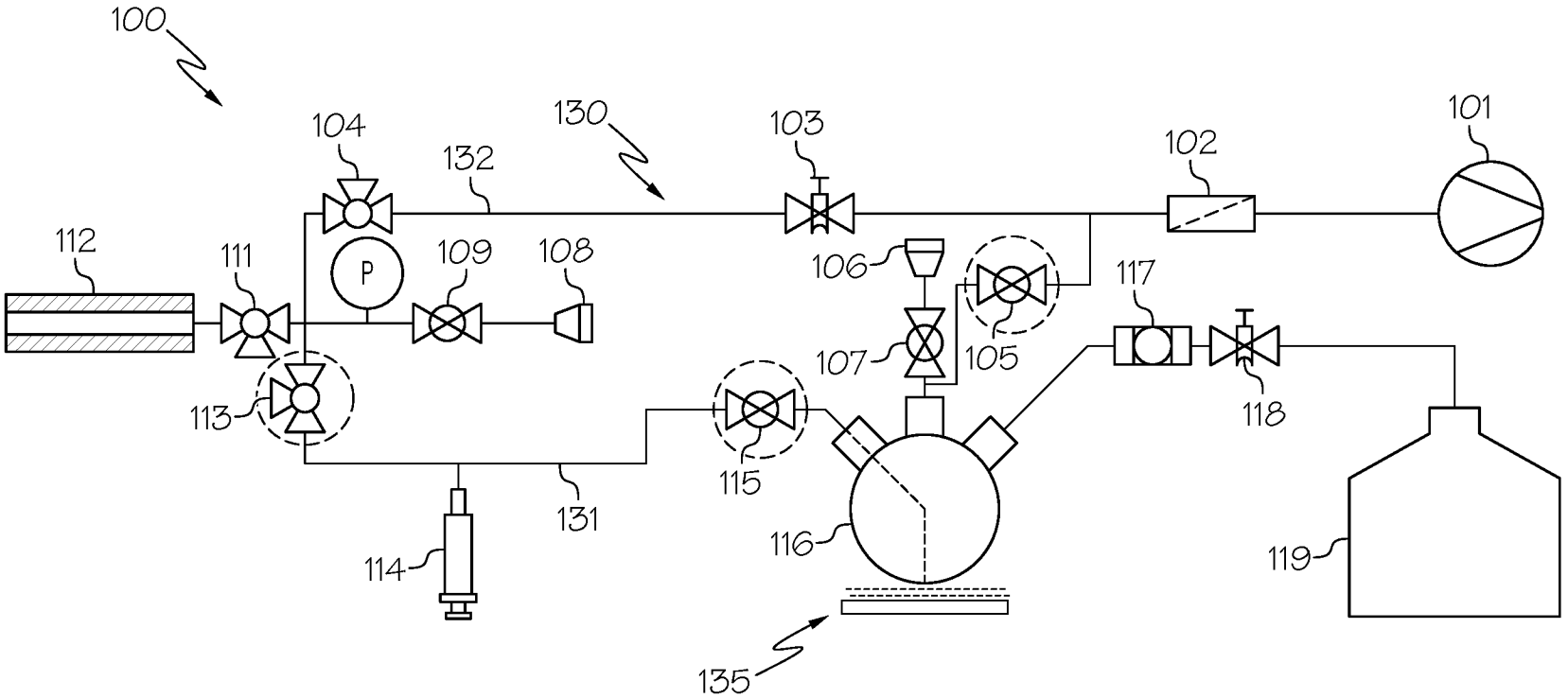
FIG. 5 schematically depicts the example system illustrated in FIG. 1 in a state for evacuating and vacuuming the system according to one or more embodiments described and illustrated herein.

Further if the phase-change thermal device 112 is a thermal switch device, the system 100 is then evacuated and vacuumed to a target level such as, without limitation, $10^{-3}$ Torr (FIG. 2, block 122). To complete this step, all of the valves are closed. Referring to FIG. 5, the third shut-off valve 105, the first shut-off valve 115, and the first valve 113 are opened. The second valve 111 is closed to maintain the pressure level within the phase-change thermal device 112.

During this step, the fluid injection device is maintained at 0 ml of working fluid. The vacuum pump 101 is operated until the vacuum level of the system 100 is at a desired level, such as measured by the digital compound pressure gauge P.

However, for other phase-change thermal devices that are not a thermal switch device (e.g., a heat pipe or a thermal ground plane), the phase-change thermal device does not need to be vacuumed. Thus, the second valve 111, the third shut-off valve 105, the first shut-off valve 115, and the first valve 113 are opened to evacuate the system and the phase-change thermal device 112.

Figure 6:
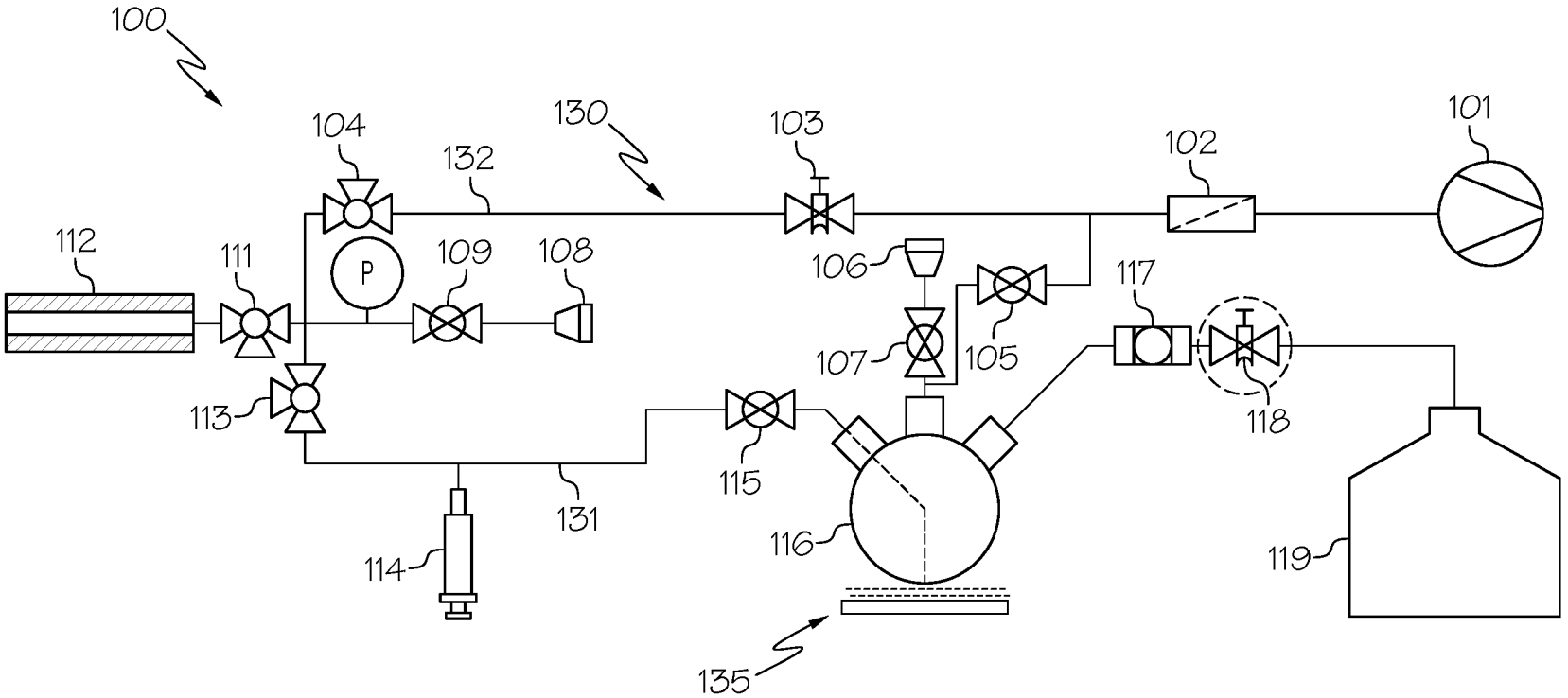
FIG. 6 schematically depicts the example system illustrated in FIG. 1 in a state for degassing a working fluid in a flask according to one or more embodiments described and illustrated herein.
Figure 7:
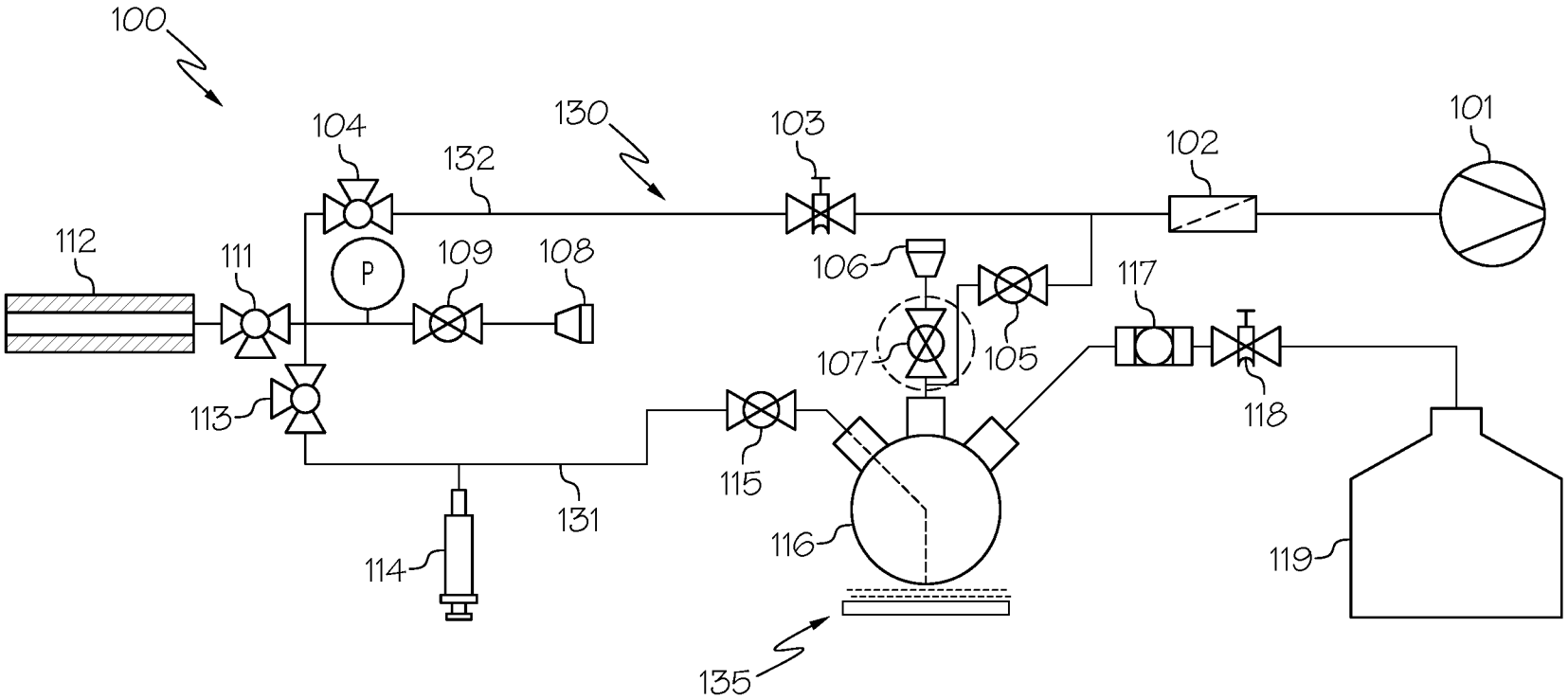
FIG. 7 schematically depicts the example system illustrated in FIG. 1 in a state for filling fluid pipe lines of the system with working fluid according to one or more embodiments described and illustrated herein.

In block 123 of FIG. 2, after achieving the desired vacuum level, the flask 116 is filled working fluid by closing all of the valves, and then adjusting the first metering valve 118 to allow working fluid into the flask 116, as shown in FIG. 6. Then, the working fluid within the flask 116 is then degassed such that the non-condensable gas is removed. In block 124 of FIG. 2, the working fluid is degassed. Referring to FIG. 7, the working fluid is degassed by having all valves closed except for the fourth shut-off valve 107. The heating element 135 is heated to boil the working fluid and therefore remove non-condensable gas through the fourth shut-off valve 107 and the exhaust 106.

Figure 8:
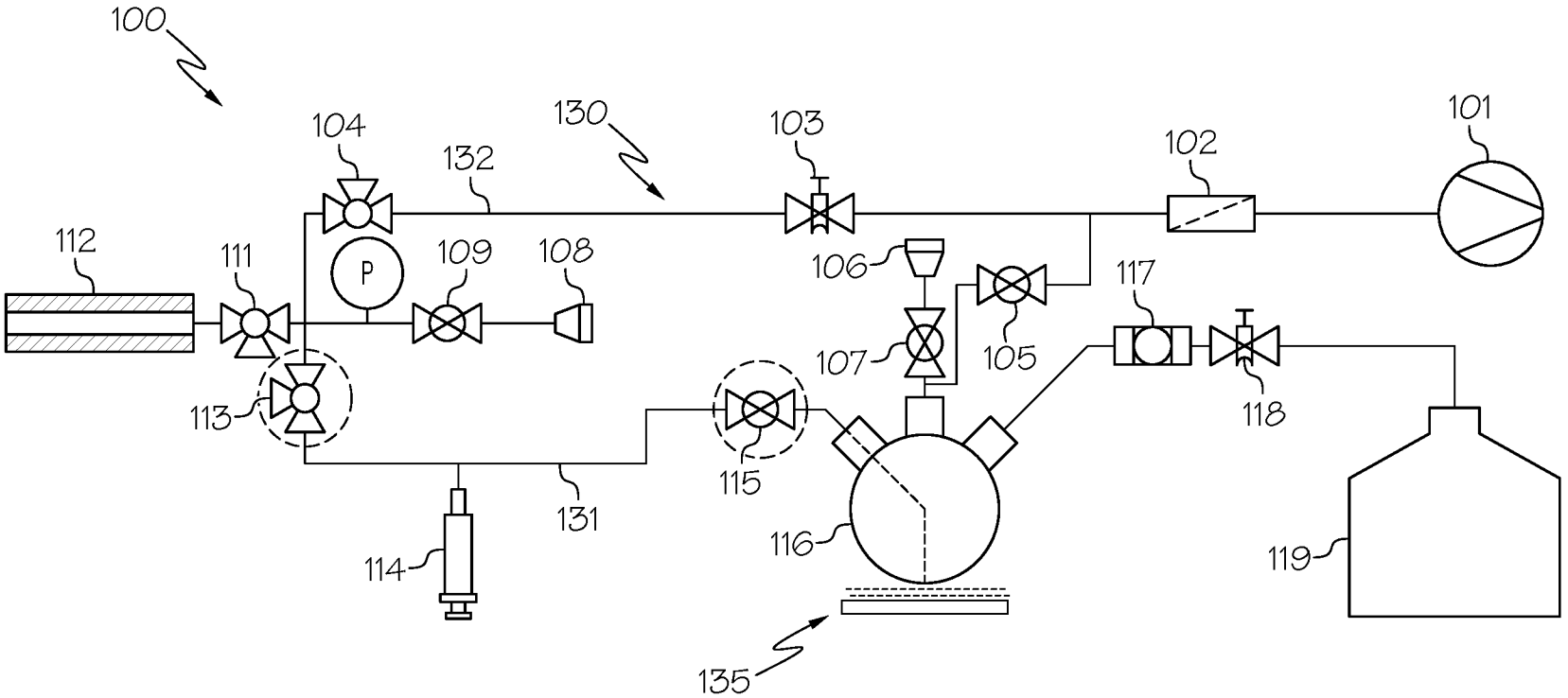
FIG. 8 schematically depicts the example system illustrated in FIG. 1 in a state for charging the fluid injection device according to one or more embodiments described and illustrated herein.

Next, the system 100 is allowed to cool down after a period of time. Then, at block 125 of FIG. 2, the first fluid line 131 is fully filled with working fluid. Referring to FIG. 8, the first shut-off valve 115 and the first valve 113 are opened to allow working fluid to fully fill the fluid line in front of the phase-change thermal device 112, which is between the first shut-off valve 115 and the second valve 111 and the third valve 104. The fluid injection device 114 is then charged at block 126 of FIG. 2. The fluid injection device 114 is charged by withdrawing fluid from the first fluid line 131 into the fluid injection device 114, which further draws fluid the flask.

Figure 9:
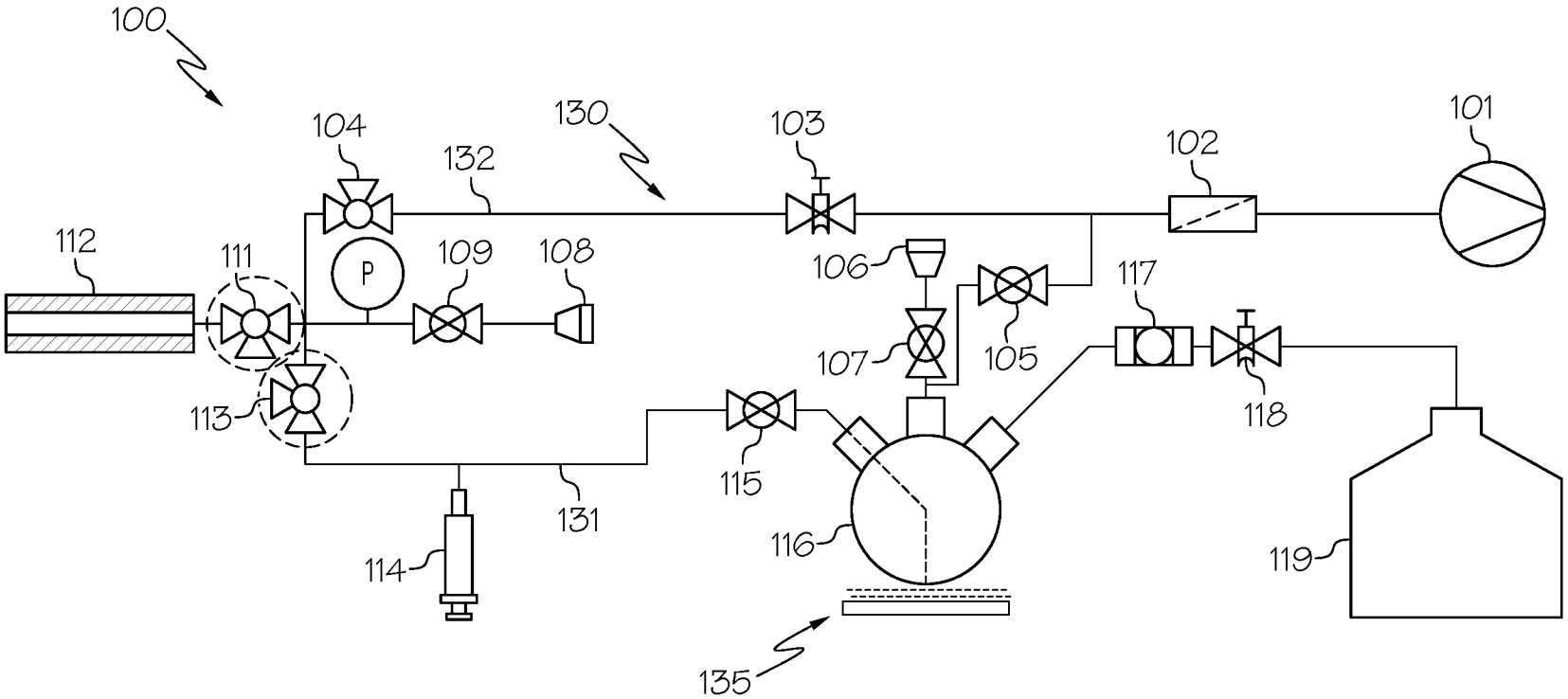
FIG. 9 schematically depicts the example system illustrated in FIG. 1 in a state for charging the phase-change thermal device according to one or more embodiments described and illustrated herein.

Referring now to FIG. 9, the phase-change thermal device 112 is charged by closing the first shut-off valve 115, which thereby closes the outlet of the flask 116 from the first fluid line 131. The second valve 111 is opened along with the first valve 113 to fluidly couple the phase-change thermal device 112 to the first fluid line 131. In block 127 of FIG. 2, the phase-change thermal device 112 is charged by actuating the fluid injection device 114 such that a precise amount of working fluid is ejected from the fluid injection device 114 and injected into the first fluid line 131, which further displaces working fluid into the phase-change thermal device 112 by an amount injected into the first fluid line 131. In this manner, a precise amount of working fluid is injected into the phase-change thermal device 112.

Figure 10:
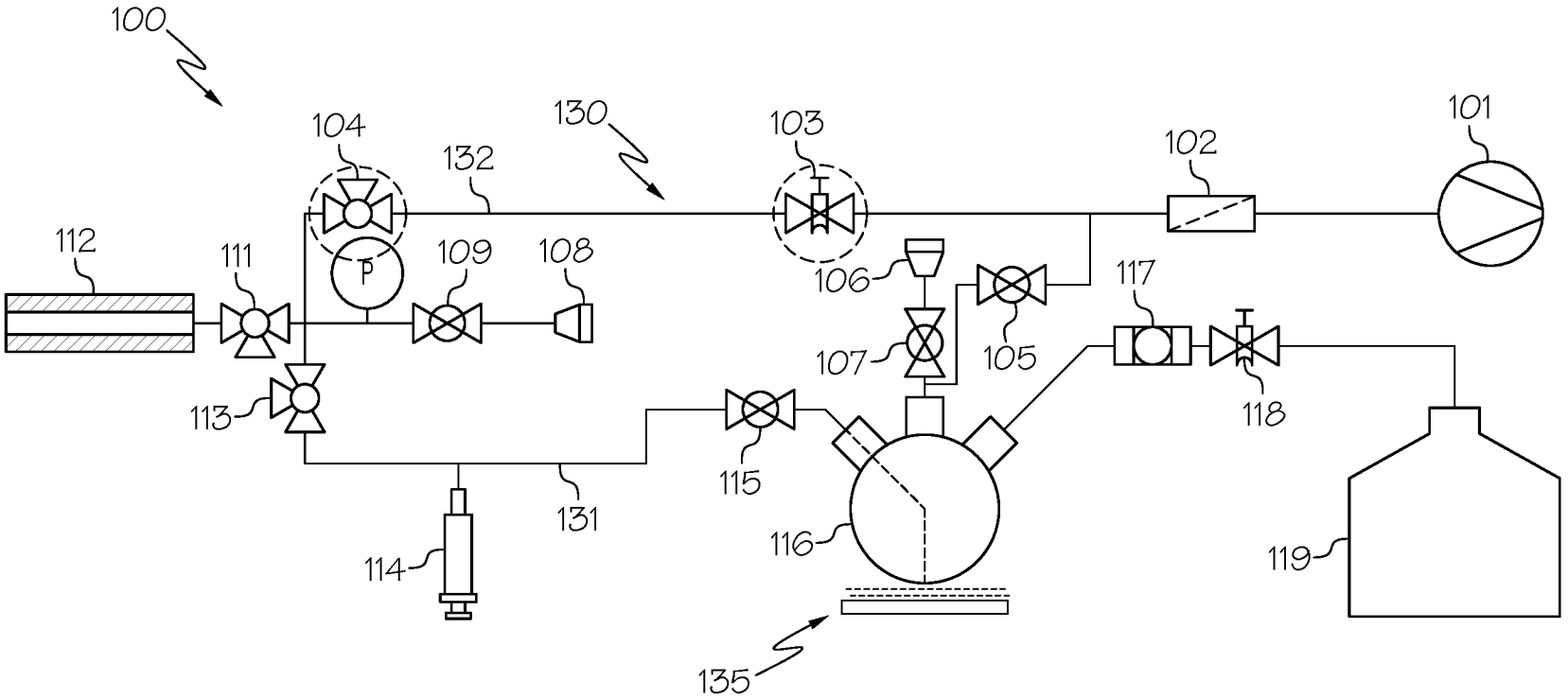
FIG. 10 schematically depicts the example system illustrated in FIG. 1 in a state for eliminating residual working fluid from the system according to one or more embodiments described and illustrated herein.

After the phase-change thermal device 112 is charged, residual working fluid within the system may be optionally removed (FIG. 2, block 128). Referring to FIG. 10, in one example method of removing residual working fluid, all valves are closed. Then, the third valve 104 and the second metering valve 103 are opened and the vacuum pump is activated to remove residual working fluid. Alternatively, the residual working fluid may be flushed from the fluid lines of the system 100 by injecting dry nitrogen into exhaust 108 through the second shut-off valve 109, while keeping the exhaust sides of the first valve 113, the second valve 111, and the third valve 104 open.

Figure 11:
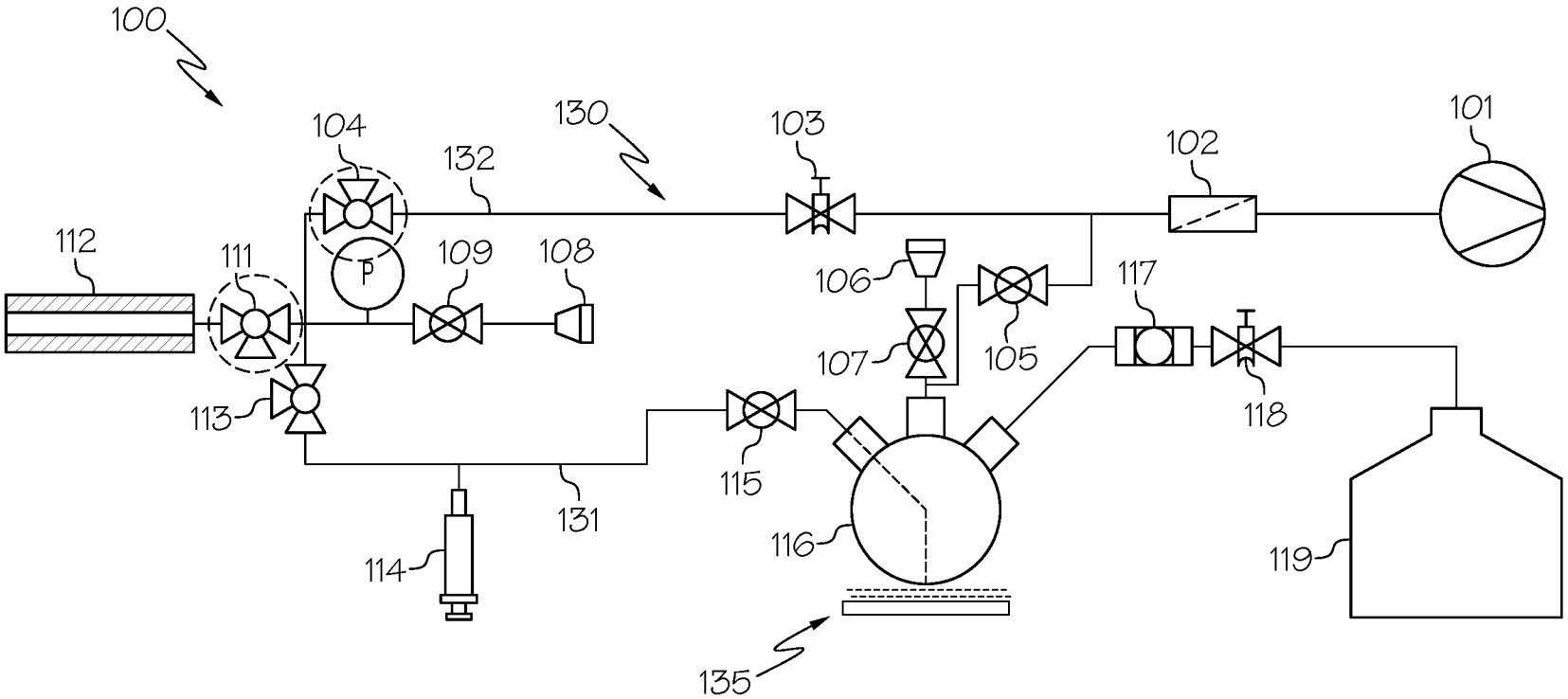
FIG. 11 schematically depicts the example system illustrated in FIG. 1 in a state for vacuuming the phase-change thermal device in a secondary vacuum process according to one or more embodiments described and illustrated herein.

Finally, if the phase-change thermal device 112 is a thermal switch device, then a secondary vacuum step may be performed to achieve a desired pressure within the phase-change thermal device 112 and therefore set the desired switching temperature of the phase-change thermal device 112 (FIG. 2, block 129). This process is skipped for other types of phase-change thermal devices. For this process, all of the valves are closed. Both sides of the phase-change thermal device 112 are heated with one or more heating elements (not shown) until an estimated inside temperature of the phase-change thermal device 112 reaches the desired switching temperature. As shown in FIG. 11, the second valve 111 and the third valve 104 are opened. As the vacuum pump 101 is activated, the second metering valve 103 is controlled to vacuum the phase-change thermal device 112. As the pressure becomes stable at the saturation pressure, the second metering valve 103 and the second valve 111 is closed. This process may be repeated until the phase-change thermal device 112 (i.e., thermal switch device) achieves stable switching at the desired switching temperature.

Figure 12:
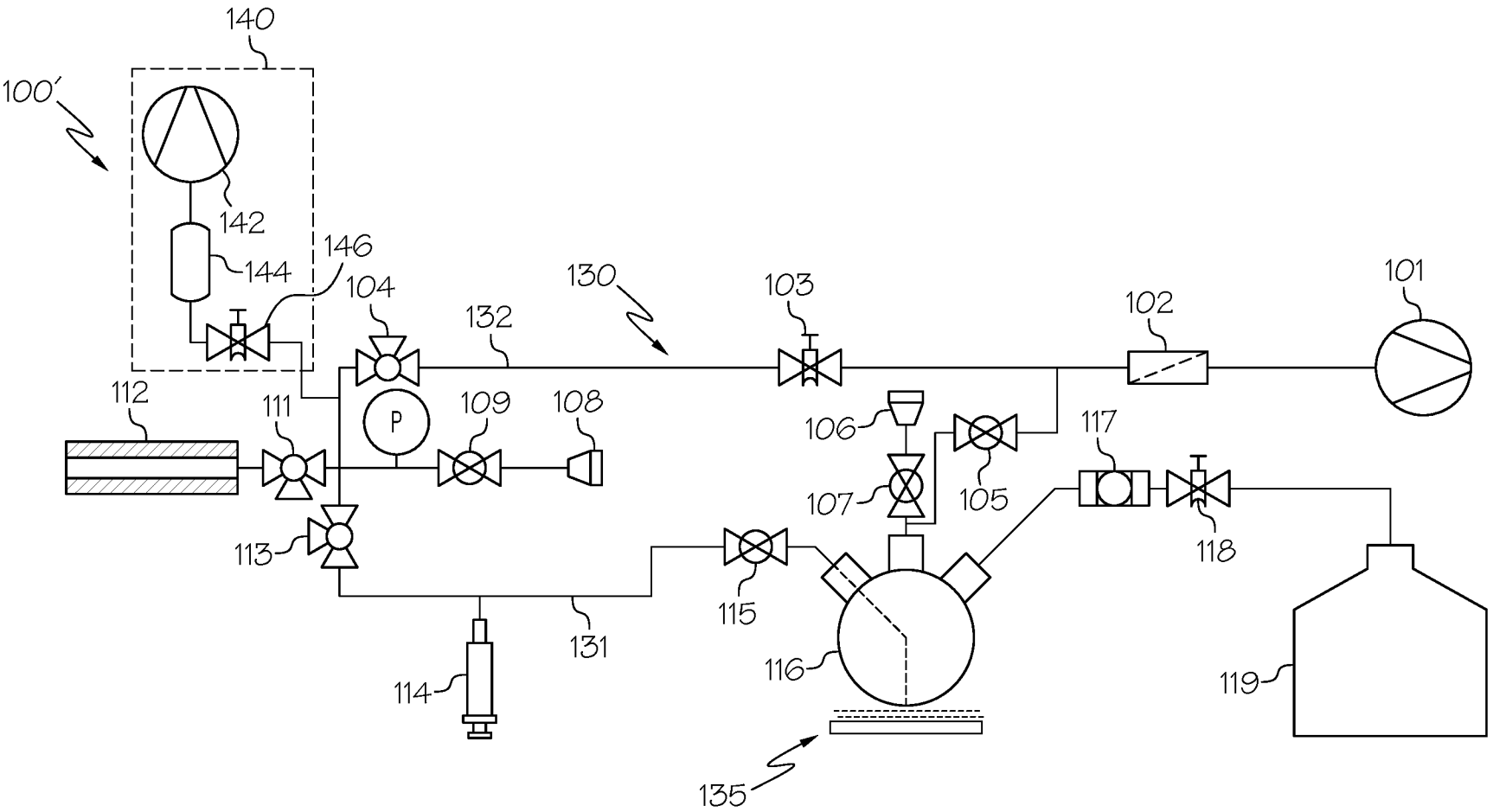
FIG. 12 schematically depicts another example system for degassing and charging a phase-change thermal device further including a vacuum buffer module according to one or more embodiments described and illustrated herein.

Referring now to FIG. 12, another example system 100' for degassing and charging a phase-change thermal device 112 is schematically illustrated. The system 100' of FIG. 12 is similar to the system 100 depicted in FIGS. 1 and 2-10 except a vacuum buffering module 140 is fluidly coupled to the fluid line between the first valve 113 and the third valve 104 (e.g., with one or more fluid couplings). The example vacuum buffering module 140 comprises a third metering valve 146, a reservoir 144, and a vacuum pump 142. The vacuum buffering module 140 is provided to remove any bubbles present within the system 100, and particularly within the first fluid line 131 in front of the phase-change thermal device 112. Bubbles present within the first fluid line 131 may affect the charging amount.

During the filling of the first fluid line 131 (see FIG. 8), the vacuum pump 142 is turned on, and the third metering valve 146 is slowly turned on. The reservoir 144 is filled with working fluid. When the reservoir 144 is partially filled, the vacuum pump 142 is turned off. This may remove any bubbles in the system 100'. The position of the vacuum buffering module 140 should be positioned lower than the position of the flask 116 but higher than the fluid line to be charged (i.e., the first fluid line 131).

Figure 13:
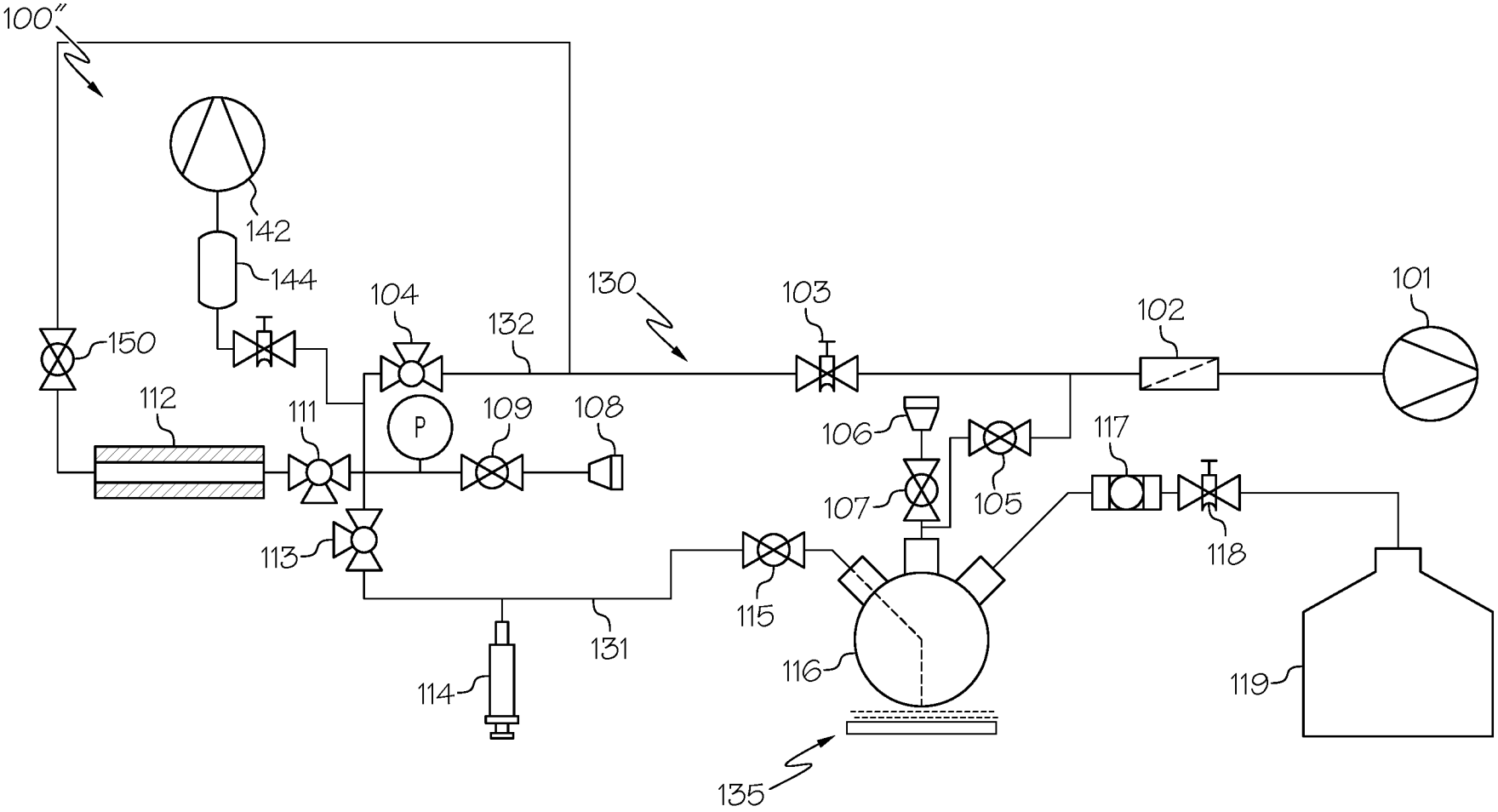
FIG. 13 schematically depicts another example system for degassing and charging a phase-change thermal device further including a vacuum bypass according to one or more embodiments described and illustrated herein.

Referring now to FIG. 13, another example system 100" for degassing and charging a phase-change thermal device 112 having a vacuum bypass is schematically illustrated. The system 100" of FIG. 13 is similar to the system 100' depicted in FIG. 12 except a fourth valve 150 is fluidly coupled to a second input of the phase-change thermal device 112 and the second fluid line 132 between the third valve 104 and the second metering valve 103 (i.e., by a third fluid line). The system 100" depicted in FIG. 13 eliminates the need to remove residual fluid from the system as depicted in FIG. 10 and described above. Rather than removing working fluid from the fluid lines (e.g., the first fluid line 131) after charging a phase-change thermal device 112, the working fluid remains in the fluid lines.

After charging one phase-change thermal device 112, it is removed from the system 100". A subsequent phase-change thermal device 112 is coupled to the system 100" at the second valve 111. A second input of the phase-change thermal device 112 is fluidly coupled to the fourth valve 150. As the fourth valve 150 is fluidly coupled to the fluid line between the third valve 104 and the second metering valve 103, the pressure within the subsequent phase-change thermal device 112 may be regulated by by-passing a majority of the fluid lines and vacuuming through the fourth valve 150 and the second input of the phase-change thermal device 112. More particularly, to regulate pressure within the phase-change thermal device 112, the fourth valve 150 is opened, the third valve 104 and the second valve 111 are closed, and the second metering valve 103 is adjusted to achieve the desired pressure within the phase-change thermal device 112.

Thus, because the fluid line from the third valve 104 to the second shut-off valve 109, the second valve 111, and the first valve 110 (i.e., the fluid line in front of the phase-change thermal device 112), the system 100" is capable of charging another phase-change thermal device after the fabrication of a previous phase-change thermal device is completed. If the fluid injection device 114 runs out of working fluid, it may be recharged by closing the first valve 113 and the opening first shut-off valve 115 to withdraw working fluid from the flask 116. Manufacturing through-put is increased because the fluid lines of the system do not need to be removed of working fluid prior to charging the next phase-change thermal device.

It should now be understood that the embodiments of the present disclosure are directed to systems and methods for degassing and charging phase-change thermal devices, such as thermal switch devices. Embodiments described herein are directed to methods and systems that integrate the functions of working fluid degassing, precise vacuum level control, and charging amount control for miniature phase-change thermal devices. Embodiments of the present disclosure enable precise charging of a phase-change thermal device (e.g., less than about 1 ml), as well as accurate vacuum control.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

The invention claimed is:

1. A system for degassing and charging a phase-change thermal device comprising:

a flask comprising an inlet for receiving a working fluid, and an outlet;

a first shut-off valve fluidly coupled to the outlet of the flask;

a first two-or-more-way valve fluidly coupled to the first shut-off valve by a fluid line;

a second two-or-more-way valve fluidly coupled to the first two-or-more-way valve, wherein the second two-or-more-way valve is operable to be fluidly coupled to the phase-change thermal device;

a second shut-off valve fluidly coupled to the second two-or-more-way valve;

a third two-or-more-way valve fluidly coupled to the first two-or-more-way valve;

a vacuum pump coupled to the third two-or-more-way valve; and a fluid injection device fluidly coupled to the fluid line between the first two-or-more-way valve and the first shut-off valve, wherein the fluid injection device is operable to draw the working fluid from the flask and inject a desired amount of the working fluid into the phase-change thermal device.

2. The system of claim 1, further comprising a heating element thermally coupled to the flask and operable to heat the working fluid within the flask.

3. The system of claim 1, wherein the second shut-off valve is fluidly coupled to atmosphere.

4. The system of claim 1, further comprising a pressure gauge positioned between the second two-or-more-way valve and the second shut off valve.

5. The system of claim 1, wherein the fluid injection device comprises a syringe.

6. The system of claim 1, wherein the desired amount of the working fluid is within a range of 0.4 ml to 1.0 ml at a tolerance of ±1%.

7. The system of claim 1, further comprising:

a metering valve fluidly coupled to the third two-or-more-way valve;

a second fluid line fluidly coupled to the metering valve; and a fluid trap fluidly coupled to the second fluid line and the vacuum pump.

8. The system of claim 7, further comprising a fourth two-or-more-way valve operable to be fluidly coupled to the phase-change thermal device and a third fluid line fluidly coupled to the second fluid line.

9. The system of claim 7, further comprising:

a third shut-off valve fluidly coupled to an exhaust output of the flask, and fluidly coupled to atmosphere; and a fourth shut-off valve fluidly coupled to the exhaust output of the flask, and fluidly coupled the second fluid line.

10. The system of claim 1, further comprising:

a filter fluidly coupled to the inlet of the flask;

a metering valve fluidly coupled to the filter; and a reservoir fluidly coupled to the metering valve.

11. The system of claim 1, wherein the phase-change thermal device is one of a thermal switch, a heat pipe, a vapor chamber, and a thermal ground plane.

12. The system of claim 1, further comprising a vacuum buffering module fluidly coupled to the second valve.

* * * * *